US011652328B2

(12) United States Patent
Takeuchi et al.

(10) Patent No.: US 11,652,328 B2
(45) Date of Patent: May 16, 2023

(54) TERMINAL CRIMPING DEVICE

(71) Applicant: Union Machinery Co., Ltd., Kanagawa (JP)

(72) Inventors: Yoshio Takeuchi, Zama (JP); Kazumasa Yoshizawa, Sagamihara (JP)

(73) Assignee: UNION MACHINERY CO., LTD., Kanagawa (JP)

( * ) Notice: Subject to any disclaimer, the term of this patent is extended or adjusted under 35 U.S.C. 154(b) by 64 days.

(21) Appl. No.: 17/336,743

(22) Filed: Jun. 2, 2021

(65) Prior Publication Data

US 2022/0239049 A1 Jul. 28, 2022

(30) Foreign Application Priority Data

Jan. 22, 2021 (JP) ..... JP2021-008790

(51) Int. Cl.
*H01R 43/052* (2006.01)
*H01R 43/05* (2006.01)

(52) U.S. Cl.
CPC ..... *H01R 43/052* (2013.01); *H01R 43/05* (2013.01)

(58) Field of Classification Search
CPC ..... H01R 43/055; H01R 43/052; H01R 43/05
See application file for complete search history.

(56) References Cited

U.S. PATENT DOCUMENTS 3,742,564 A * 7/1973 Dyksterhouse ..... H01R 43/052 29/564.6
4,856,187 A * 8/1989 Blaha ..... H01R 43/052 29/564.6
2007/0079501 A1* 4/2007 Garner ..... H01R 43/055 29/748
2022/0239049 A1* 7/2022 Takeuchi ..... H01R 43/055

FOREIGN PATENT DOCUMENTS

JP 2014-143037 A 8/2014
JP 2016-213029 A 12/2016

* cited by examiner

*Primary Examiner* — Minh N Trinh
(74) *Attorney, Agent, or Firm* — Studebaker & Brackett PC

(57) ABSTRACT

A terminal crimping device 1 comprises a terminal cutting device 260 configured to cut off a terminal 130 provided on a band-shaped terminal carrier 140 from the terminal carrier, a terminal carrying unit 270 configured to carry the terminal 130 separated from the terminal carrier 140 by the cutting unit 260 to a terminal crimping work unit 14, a cable carrier 210 for carrying the electric cable 110 to the terminal crimping work unit 14, a crimping device 280 configured to crimp the terminal 130 carried to the terminal crimping work unit 14 by the terminal carrying unit 210 to the tip end of the electric wire 112 of the electric cable 110 carried to the terminal crimping work unit 14 by the cable carrying unit 210.

6 Claims, 12 Drawing Sheets

TERMINAL CRIMPING DEVICE

TECHNICAL FIELD

The present invention relates to a terminal crimping device for crimping a terminal to the tip end of an electric wire extending from one end of a sheath of an electric cable.

TECHNICAL BACKGROUND

A terminal crimping device is known, which is provided with a crimping means for crimping a terminal to the tip end of an electric wire, a terminal carrying means for carrying the terminal to a crimping position where the crimping means is provided, and an electric wire carrying means for carrying the electric wire before the terminal crimping to the crimping position. In order to supply terminals to such a terminal crimping device, a band-shaped terminal carrier may be used. The terminal carrier is for continuously supplying many terminals, and the terminals are arranged at a predetermined interval on one side edge of the terminal carrier.

In some cases, the terminal to be crimped is carried to the crimping position in a state where the terminal is provided on a band-shaped terminal carrier (in a state connected to one side edge portion of the terminal carrier). In contrast, in other cases, the terminal carrier is cut into a predetermined length. The crimped terminal is separated from other terminals before being carried to the crimping position. In the latter case, the terminal separated from the other terminals is carried to the crimping position with a part of the terminal carrier (also referred to as a "carrier piece") attached thereto. The terminal is crimped to the tip end of the electric wire also carried to the crimping position. The carrier piece is separated from the terminal (see, for example, Japanese Laid-Open Patent Publication Nos. 2014-143037(A) and 2016-213029(A)).

SUMMARY OF THE INVENTION

Problems to be Solved by the Invention

An electric cable is known, which has a structure in which a cylindrical sheath houses an electric wire. When a terminal is crimped to the electric wire in such an electric cable, it is necessary to form the electric cable in advance so that the electric wire extends from one end portion of the sheath. As the extension length of the electric wire from the sheath end portion increases, there is a fear that an adverse effect such as noise easily gets on a transmitted signal occurs. Therefore, it is desirable to crimp the terminal with the extension length of the electric wire from the sheath end portion as short as possible.

However, shortening the extension length of the electric wire from the sheath end portion reduces the space (distance) between the sheath end portion and the crimped portion (the portion to which the terminal is crimped) of the electric wire. Therefore, when the terminal to be crimped is carried to the crimping position in a state where the terminal is provided on the band-shaped terminal carrier or in a state where the terminal is attached to the carrier, the terminal carrier or the carrier piece interferes with the sheath when the terminal is carried, the positional deviation between the terminal and the electric wire makes it difficult to crimp the terminal properly.

The object of the present invention is to provide a terminal crimping device capable of crimping a terminal to an electric wire while suppressing the positional deviation between a terminal and a tip end of the electric wire even in an electric cable having a short extension length of the electric wire from a sheath end portion.

Means to Solve the Problems

Disclosed is a terminal crimping device according to the present invention which has a cylindrical sheath and electric wire housed in the sheath, wherein the terminal crimping device crimps a terminal to the tip end of the electric wire of an electric cable having the tip end of the electric wire extending from one end of the sheath, comprising: a cutting device for cutting off a terminal provided in a band-shaped terminal carrier from the terminal carrier; a terminal carrying unit for carrying the terminal separated from the terminal carrier by the cutting device to a crimping position (for example, the terminal crimping work unit 14 in the embodiment); a cable carrier for carrying the electric cable to the crimping position; and a crimping device provided in the crimping position for crimping the terminal carried to the crimping position by the terminal carrying unit to the tip end of the electric wire of the electric cable carried to the crimping position by the cable carrier.

The terminal crimping device according to the present invention is preferably provided with an orientation adjuster (for example, the electric wire orientation adjuster 220 in the embodiment) for adjusting the orientation of the tip end of the electric wire before the crimping of the terminal is performed, wherein the cable carrier carries the electric cable to an adjustment position (for example, the electric wire orientation adjustment unit 11 in the embodiment) where the orientation adjuster is provided, and the orientation adjuster grips the tip end of the electric wire of the electric cable carried to the adjustment position by the cable carrier adjusts the orientation by swinging the tip end of the held electric wire.

In the terminal crimping device according to the present invention, preferably, the electric wire has a core wire and a covering body for insulating covering the core wire and is provided with a cover stripper (for example, an electric-wire-cutting-and-cover-stripping device (230) in the embodiment) for stripping the covering body from the electric wire whose orientation has been adjusted by the orientation adjuster. The cable carrier carries the orientation-adjusted cable whose orientation has been adjusted by the orientation adjuster to a stripping position (for example, an electric-wire-cutting-and-cover-stripping unit 12 in the embodiment) where the cover stripper is provided. The cover stripper is configured to strip part of the covering body at the tip end of the electric wire of the orientation adjusted cable carried to the stripping position by the cable carrier while holding the tip end of the electric wire.

In the terminal crimping device according to the present invention, preferably, the cable carrier is configured to carry a terminal-equipped cable produced by crimping the terminal to the tip end of the electric wire of the electric cable by the crimping device from the crimping position to a take-out position (for example, the cable insertion unit 8 in the embodiment), and includes a crimping portion inspection device (for example, the image inspection device 240 in the embodiment) for inspecting the crimping portion of the terminal-equipped cable by image analysis while the cable carrier is carrying the terminal-equipped cable from the crimping position to the take-out position.

In addition, in the terminal crimping device according to the present invention, preferably, the cable carrier is configured to transport a stripped cable having a part of the covering body stripped from the tip end of the electric wire by the coating stripping device from the stripping position to the crimping position. The crimping portion inspection device is configured to inspect the stripped portion of the stripped cable by image analysis, while the cable carrier carries the stripped cable from the stripping position to the crimping position.

In addition, the terminal crimping device according to the present invention, preferably, is provided a cable retainer capable of holding the electric cable in a state in which the electric wire extends from one side edge portion. The cable carrier has a retainer installation unit (for example, the cable carrier moving body 212 in the embodiment). The cable retainer holding the electric cable is installed and movable. The retainer installation unit in which the cable retainer is installed is moved to carry the electric cable.

In the terminal crimping device according to the present invention, preferably, the electric cable has a plurality of electric wires. The cable retainer is configured to hold some of the electric wires in a state of being bent toward the other end of the sheath when holding the electric cable.

Advantageous Effects of the Invention

According to the terminal crimping device of the present invention, an electric cable is carried to a crimping position by a cable carrier, a terminal provided on a band-shaped terminal carrier is separated from the terminal carrier by a cutting device. The separated terminal is carried to the crimping position by the terminal carrying unit. Then, the terminal separated from the terminal carrier is crimped to the tip end (crimped portion) of the electric wire extending from one end portion of the sheath of the electric cable by the crimping device provided at the crimping position. According to the present invention, even in an electric cable in which the length of extension of the electric wire from the sheath end portion is short, the space between the sheath end portion and the crimped portion of the electric wire is small. The terminal carrier or carrier piece is not attached to the terminal carried to the crimping position. Therefore, there is no possibility that the sheath of the electric cable and the terminal carrier or carrier piece interfere with each other at the crimping position. Therefore, even in such an electric cable, it is possible to appropriately crimp the terminal to the electric wire by suppressing the positional deviation between the crimped portion and the terminal of the electric wire extending from the sheath end portion.

In addition, according to the terminal crimping device of the present invention, an orientation adjuster for adjusting the orientation of the tip end of the electric wire before crimping the terminal is provided at the adjustment position, the orientation adjuster holds the tip end of the electric wire of the electric cable carried to the adjustment position by the cable carrier. Swinging the tip end of the held electric wire adjusts the orientation. The orientation of the tip end of the electric wire extending from the sheath end portion can be adjusted to an appropriate orientation that facilitates the alignment with the terminal to be crimped. Therefore, it is possible to suppress the positional deviation between the tip end (crimped portion) of the electric wire extending from the sheath end portion and the terminal to be crimped with high accuracy and crimp the terminal.

In addition, according to the terminal crimping device of the present invention, by providing at the stripping position a cover stripping device for stripping off a covering body for insulating the core wire from the electric wire whose orientation has been adjusted by the orientation adjusting device, carrying the orientation-adjusted cable whose orientation has been adjusted by the orientation adjusting device to the stripping position by the cable carrier, and stripping off a part of the covering body at the tip end while holding the tip end of the electric wire of the carried orientation-adjusted cable by the cover stripping device, it is possible to strip off a part of the covering body at the tip end of the electric wire extending from the sheath end with high accuracy.

In addition, according to the terminal crimping device of the present invention, the cable carrier comprises a terminal-equipped cable formed by crimping a terminal to the tip end of an electric wire by a crimping device is carried from the crimping position to the take-out position. The crimping portion inspection device is provided for inspecting the crimping portion of the terminal-equipped cable by image analysis while carrying the terminal-equipped cable from the crimping position to the take-out position, whereby it is possible to accurately inspect whether or not the terminal is appropriately crimped to the crimped portion of the electric wire extending from the sheath end.

In addition, according to the terminal crimping device of the present invention, transporting a stripped cable in which a part of the covering body is stripped from the tip end of the electric wire by the coating stripping device from the stripping position to the crimping position by the cable carrier, and inspecting the stripped portion of the stripped cable by image analysis by the crimping portion inspection device, while transporting the stripped cable from the stripping position to the crimping position, enable accurately inspecting whether or not a part of the covering body is properly stripped from the tip end of the electric wire extending from the sheath end.

In addition, the terminal crimping device according to the present invention is provided with a cable retainer capable of holding an electric cable in a state where an electric wire extends from one side edge portion. The cable carrier has a retainer installation unit where the cable retainer for holding the electric cable is installed and movable. The electric cable is carried by moving the retainer installation unit where the cable retainer is installed, whereby the electric cable can be carried to each position with high accuracy. In addition, providing a plurality of cable retainers enables setting another electric cable in another cable retainer while setting an electric cable in a cable retainer so that workability can be improved.

Further, according to the terminal crimping device of the present invention, when holding an electric cable having a plurality of electric wires, the cable retainer is configured so that some of the electric wires among the plurality of electric wires can be held in a state of being bent toward the other end portion of the sheath, whereby it is possible to prevent the electric wires held in the bent state from coming into contact with a device constituent member such as a crimping device and being damaged during transportation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

FIG. 2 (FIGS. 2A-2F) is a diagram illustrating an electric cable used in the terminal crimping device.

FIG. 3 (FIGS. 3A-3B) shows a terminal to be crimped to the electric cable.

FIG. 4 (FIGS. 4A-4C) is a view showing a cable retainer for holding the electric cable, wherein

FIG. 7 (FIGS. 7A-7C) is a schematic diagram showing a configuration and a function of an electric wire orientation adjusting unit of the terminal crimping device, wherein

DESCRIPTION OF THE EMBODIMENTS

Figure 1:
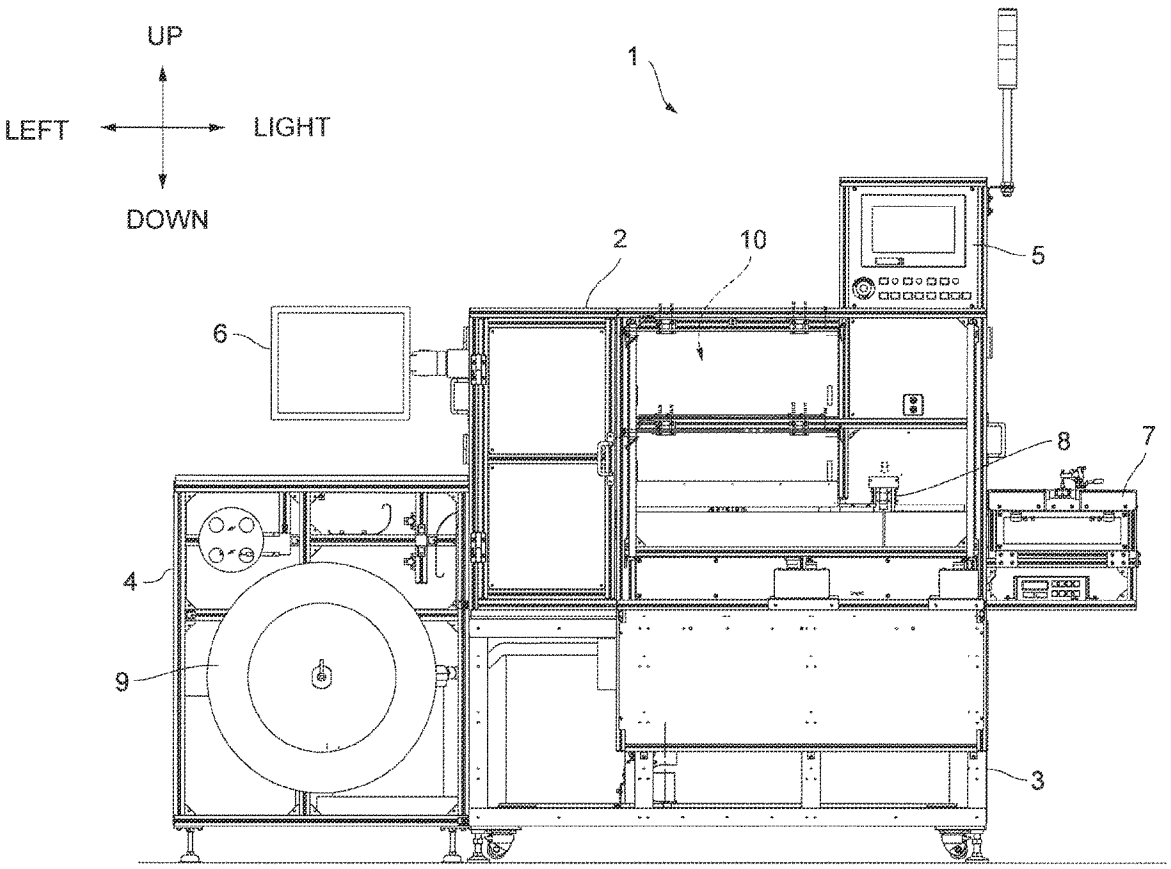
FIG. 1 is a front view of a terminal crimping device according to an embodiment of the present invention.

Hereinafter, a preferred embodiment of the present invention will be described with reference to the drawings. FIG. 1 shows a terminal crimping device 1 according to an embodiment of the present invention. First, a general configuration of the terminal crimping device 1 will be described with reference to FIG. 1. In the following description, the vertical and horizontal directions are referred to in accordance with the directions indicated by the cross arrows shown in FIG. 1. Further, the direction from the rear side of the sheet of FIG. 1 toward the front side of the sheet of FIG. 1 is referred to as the forward direction. The direction from the front side of the sheet of FIG. 1 toward the back side of the sheet of FIG. 1 is referred to as the backward direction.

As shown in FIG. 1, the terminal crimping device 1 includes an apparatus housing 2, an apparatus frame 3 for supporting the apparatus housing 2, a terminal supply frame 4 arranged on the left side of the apparatus housing 2 and the apparatus frame 3, an operation panel 5 arranged on the upper portion of the apparatus housing 2, an image display monitor 6 arranged on the left side of the apparatus housing 2, and a cable set table 7 arranged on the right side of the apparatus housing 2. The apparatus housing 2 includes a frame member assembled in a rectangular parallelepiped shape and a plurality of transparent panel members arranged to cover the front surface of the apparatus housing 2. An apparatus main unit 10 (described in detail later) is provided in the apparatus housing 2. A cable insertion unit 8 is provided on the front surface of the apparatus housing 2.

The terminal supply frame 4 is provided with a terminal reel 9 around which terminal carrier 140 (see FIG. 3), described later, is wound. The operation panel 5 is provided with various operation switches operated to start and stop the operation of the terminal crimping device 1, various display lamps indicating the operating state of the terminal crimping device 1, and the like. The image display monitor 6 is configured to display images captured in the cover stripping portion inspection and the crimping portion inspection described later. The cable set base 7 is configured to perform a cable set operation described later.

Figure 2A:
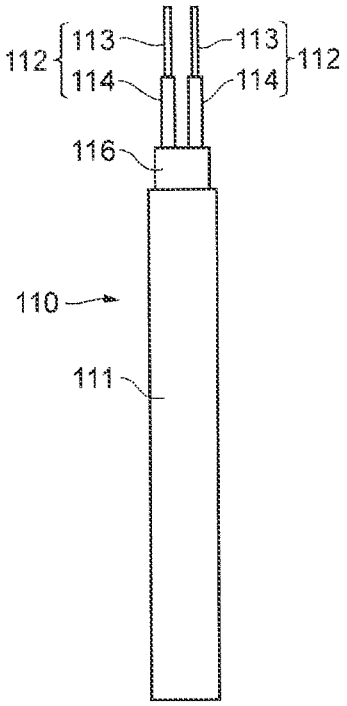
FIG. 2A shows the configuration of the electric cable.
Figure 2B:
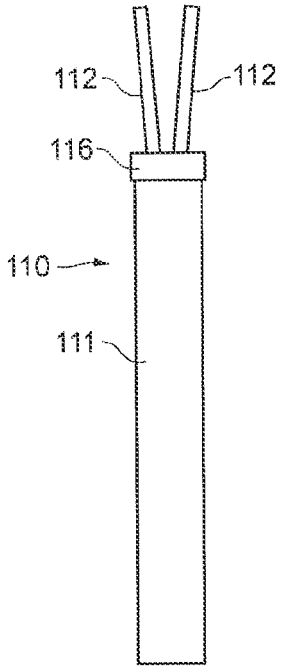
FIG. 2B shows the state of the electric cable when the cable retainer holds it.

Next, the electric cable 110 and the terminal 130 supplied to the terminal crimping device 1 will be described with reference to FIGS. 2 and 3. As shown in FIG. 2A, the electric cable 110 has a tubular sheath 111, two electric wires 112 contained in the sheath 111, and a shield 116 disposed between the sheath 111 and the electric wires 112. Each electric wire 112 comprises a core wire 113 made of one or a plurality of element wires and a tubular covering body 114 that insulates and covers the core wire 113. Shield 116 comprises, for example, a mesh net wire. The core wire 113 and the shield 116 are formed of conductive material. The sheath 111 and the covering body 114 are formed of insulating material.

The electric cable 110 is, for example, a high-frequency cable for transmitting a high-frequency signal, and a shield 116 is provided to reduce noise during signal transmission and improve high-frequency characteristics. As will be described in detail later, in this electric cable 110, a part of the sheath 111 is stripped so that two electric wires 112 extend from the tip portion of the sheath 111. A terminal 130 is crimped against the tip end of each electric wire 112 extending from the sheath 111. When the extended length of the electric wire 112 from the sheath 111 increases, there is a fear that noise may be superimposed on the transmission signal, and the high-frequency characteristics may deteriorate. Therefore, it is preferable to shorten the extension length of the electric wire 112 from the sheath 111.

Figure 3A:
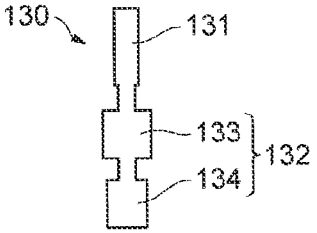
FIG. 3A is a plan view showing a single terminal and FIG. 3B is a plan view showing a state in which a plurality of terminals are provided on a terminal carrier.

As shown in FIG. 3A, the terminal 130 is, for example, a terminal housed in a connector housing (not shown) and is provided with an electric connection unit 131, which is fitted with a terminal (not shown) housed in a mating connector housing and electrically connected thereto, and a crimping piece portion 132 which is crimped to the electric wire 112 of the electric cable 110. The crimping piece portion 132 is configured to include a core wire crimping piece unit 133, which is crimped to the core wire 113 of the electric wire 112, and a covering-body-crimping-piece portion 134 crimped to the covering body 114 of the electric wire 112.

Figure 3B:
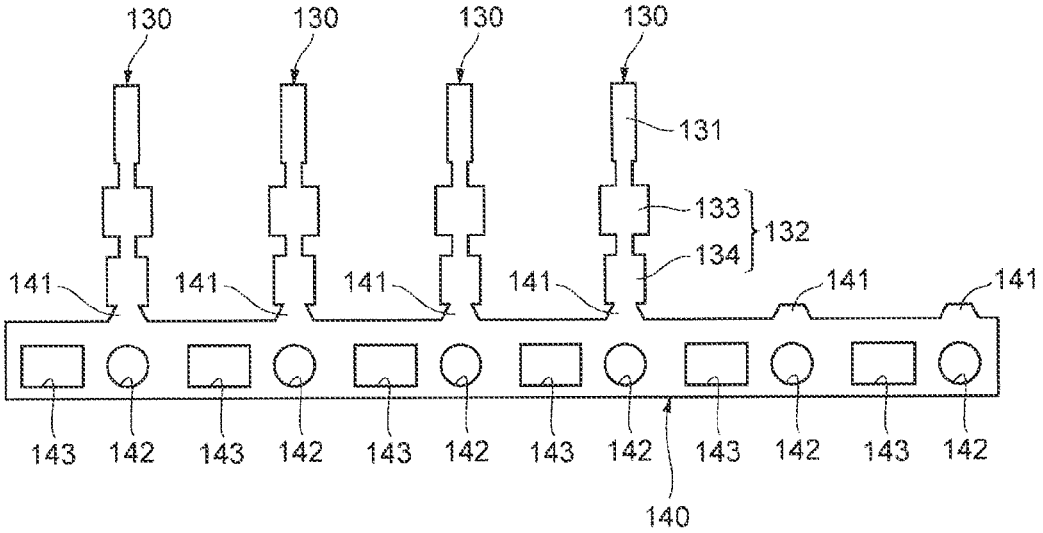

As shown in FIG. 3B, the terminals 130 are supplied to the terminal crimping device 1 in a state where they are provided in the band-shaped terminal carrier 140. The terminal carrier 140 is for continuously supplying many terminals 130. The terminals 130 are provided at predetermined intervals on one side edge portion of the terminal carrier 140. Specifically, terminal mounting pieces 141 are provided at predetermined intervals on one side edge portion of the terminal carrier 140. The terminals 130 are provided at the terminal carrier 140 so that the covering-body-crimping-piece portions 134 are integrally connected to the terminal mounting pieces 141. The terminal carrier 140 has a plurality of engagement holes 142 and 143 formed at predetermined intervals on the terminal carrier 140 for use in moving the terminal carrier 140. In the state where they are provided in the terminal carrier 140, the core wire crimping piece units 133 and the covering-body-crimping-piece portions 134 of the terminals 130 are bent in advance to have a U-shape when viewed from the front.

Figure 4A:
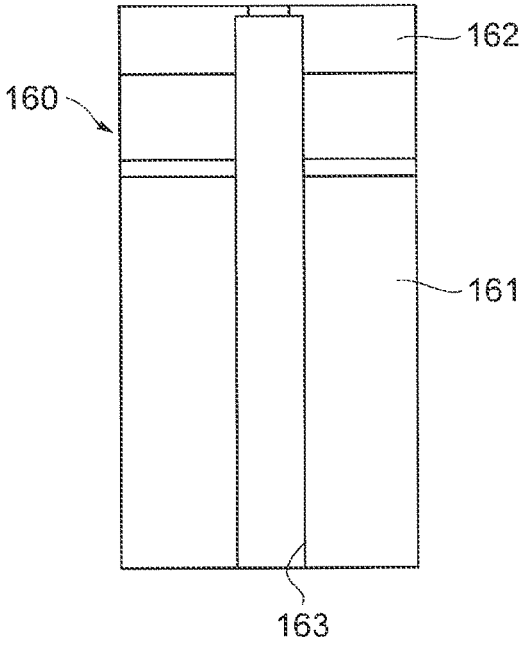
FIG. 4A is a plan view of a state in which the electric cable is not held.
Figure 4B:
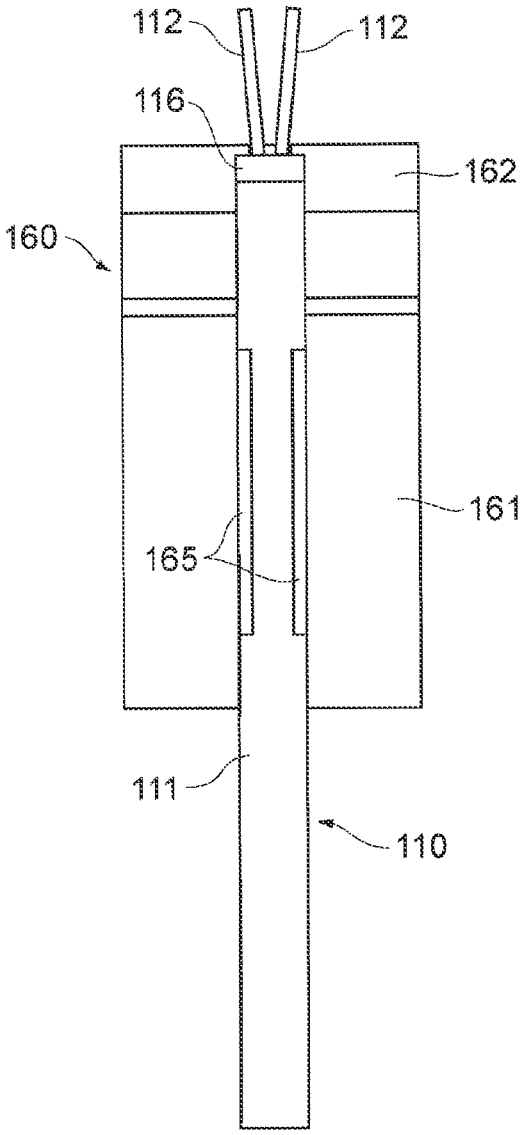
FIG. 4B is a plan view of a state in which the electric cable is held.
Figure 4C:
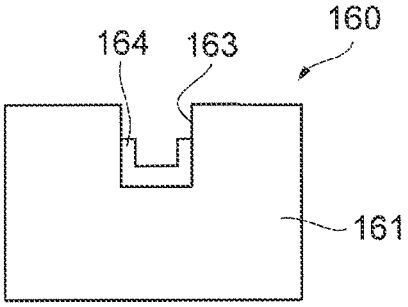
FIG. 4C is a front view of a state in which the electric cable is not held.
Figure 5:
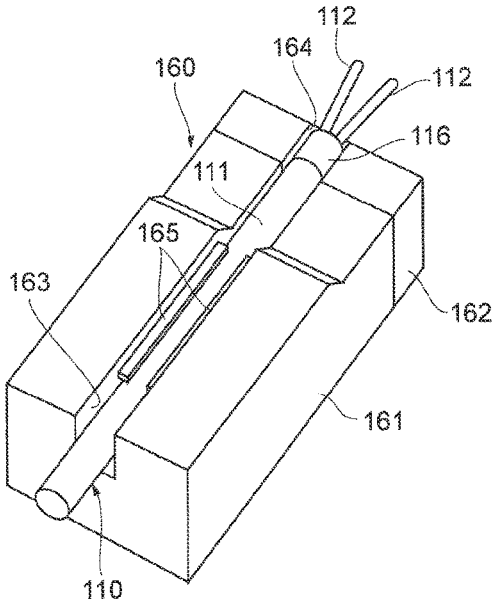
FIG. 5 is a perspective view of a cable retainer holding the electrical cable.

Next, with reference to FIGS. 4 and 5, a cable retainer 160 for holding the electric cable 110 will be described. As shown in FIGS. 4B and 5, the electric cable 110 is supplied to the terminal crimping device 1 while being held by the cable retainer 160. The cable retainer 160 has a main body unit 161 and an attachment unit 162 detachably attached to the main body unit 161. A holding groove 163 extending in the front-rear direction is formed in the upper surface portion of the main body unit 161 and the attachment unit 162. An abutting wall 164 (see FIG. 4C) formed in a concave shape in a front view is provided at an end portion of the holding groove 163 on the front end side (attachment unit 162 side). The main body unit 161 is provided with a pair of pressing members 165 that operate to protrude or retract into the holding groove 163 from both right and left sides of the holding groove 163, and a pressing member operating mechanism (not shown) for operating the pressing member 165.

An electric cable 110 is placed in a holding groove 163 at a predetermined length on the tip end side thereof. It is set and held in a cable retainer 160 by operating a pair of pressing members 165 to protrude into the holding groove 163. The electric cable 110 is formed in advance such that a sheath 111 and a shield 116 on the distal end side thereof are partially stripped, and two electric wires 112 extend from the end portion of the sheath 111. Shield 116 is stripped so as to remain longer than the sheath 111. After removal, a portion extending from the end portion of the sheath 111 is folded back toward the sheath 111 side (see also FIG. 2B). As shown in FIG. 4B, the electric cable 110 is placed in the holding groove 163 while the end portion of the sheath 111 abuts against the abutting wall 164. Two electric wires 112 extend from the distal side edge of the cable retainer 160 and are set in the cable retainer 160.

The setting operation of the electric cable 110 to the cable retainer 160 (referred to as "cable setting operation") is performed manually by an operator on the cable setting table 7 (see FIG. 1). The cable setting table 7 is provided with a mounting unit (not shown) on which the cable retainer 160 is mounted and held, and a pressing member operating mechanism (not shown) for operating the pressing member 165 of the cable retainer 160 mounted on the mounting unit through the pressing member operating mechanism. The cable setting operation supplies the electric cable 110 set to the cable retainer 160 to the terminal crimping device 1 from the cable insertion unit 8 (see FIG. 1) while the electric cable 110 is held by the cable retainer 160.

Figure 6:
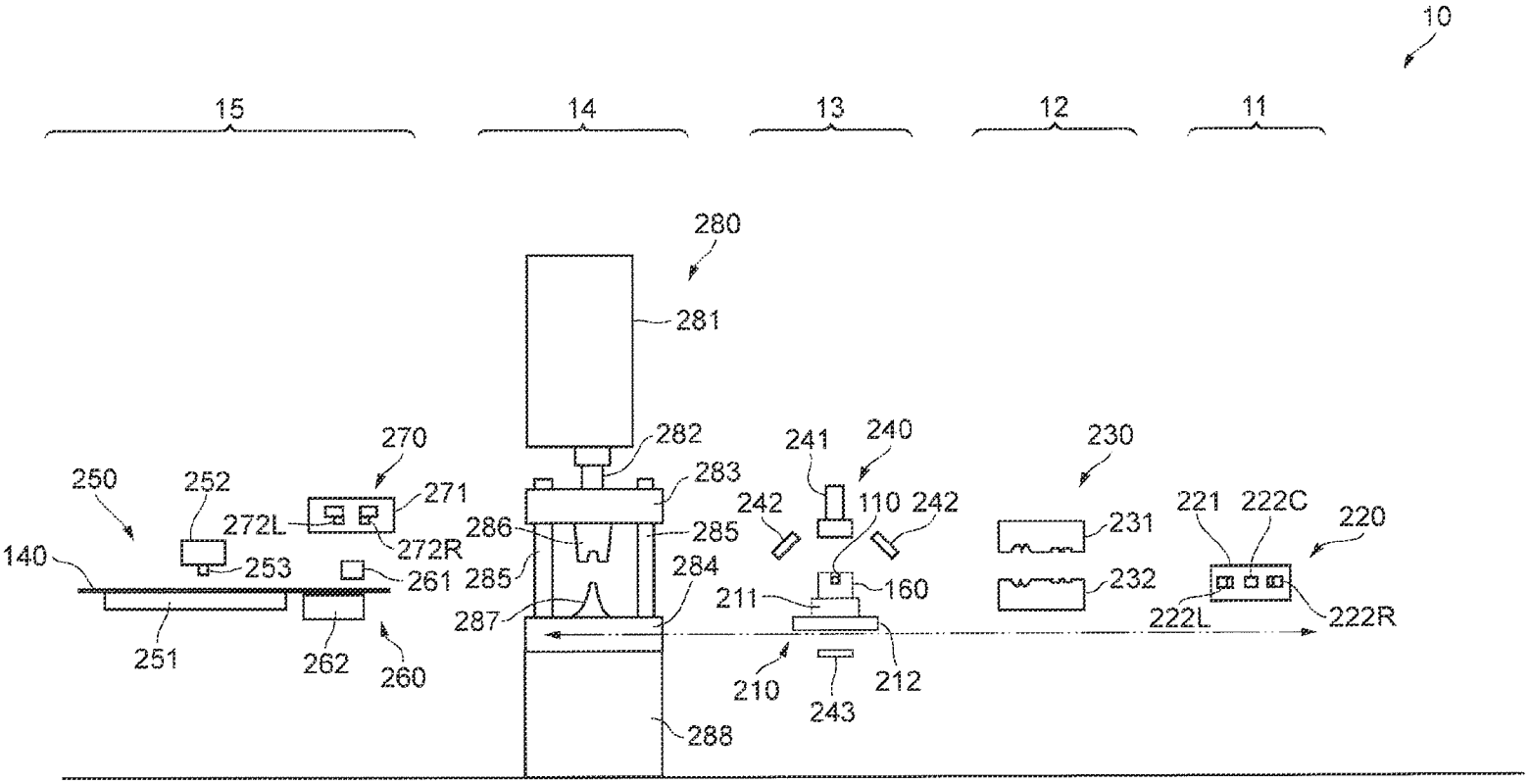
FIG. 6 is a schematic view showing a configuration of the apparatus main unit of the terminal crimping device.

Next, the apparatus main unit 10 of the terminal crimping device 1 will be described with reference to FIGS. 6 to 11. As shown in FIG. 6, the apparatus main unit 10 includes the electric wire orientation adjustment unit 11, the electric-wire-cutting-and-cover-stripping unit 12, the inspection work unit 13, the terminal crimping work unit 14, and the terminal-supply-and-carrying-work unit 15, and the cable carrier 210 for carrying the electric cable 110 held by the cable retainer 160.

A cable carrier 210 is provided with a cable carrier moving body 212 provided with a holding member 211 for holding a cable retainer 160, and a moving body operating mechanism (not shown) for operating the cable carrier moving body 212 to be movable within the apparatus main unit 10 of the device. The cable carrier moving body 212 is configured to be movable in each of the forward, backward, left, right, up, and down directions, and the cable retainer 160 holding the electric cable 110 can be moved between the cable insertion unit 8 (see FIG. 1), the electric wire orientation adjustment unit 11, and the terminal crimping work unit 14. The two arrows of the two-dot chain line shown in FIG. 6 illustrate the movable range of the cable carrier moving body 212 in the left and right direction within the main part 10 of the device.

As shown in FIG. 6, the electric wire orientation adjusting unit 11 is provided with an electric wire orientation adjuster 220. The electric wire orientation adjuster 220 includes an electric wire holder 221 and an electric wire holder operating mechanism (not shown) for operating the electric wire holder 221 to be movable and swingable within the electric wire orientation adjustment unit 11. The electric wire holder 221 is configured to be movable in each of the forward, backward, left, right, up, and down directions and swingable in the vertical direction. As shown in FIG. 7, the electric wire holder 221 has three holding pieces: a center holding piece 222C, a left holding piece 222L, and a right holding piece 222R. The center holding piece 222C is fixed. The left holding piece 222L and the right holding piece 222R are movable in the horizontal direction with respect to the center holding piece 222C. When the left holding piece 222L and the right holding piece 222R are moved toward the center holding piece 222C, the three holding pieces are closed. When the left holding piece 222L and the right holding piece 222R have moved away from the center holding piece 222C, the three holding pieces are opened.

Figure 7A:
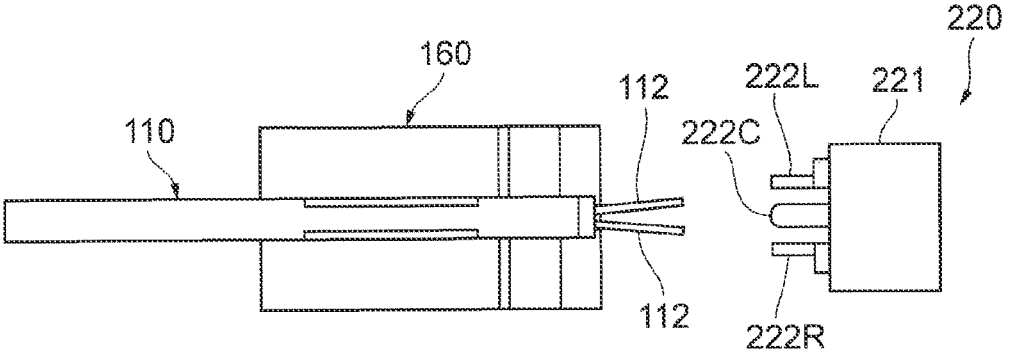
FIG. 7A is a plan view showing a state before the orientation adjusting unit grips the electric wire.
Figure 7B:
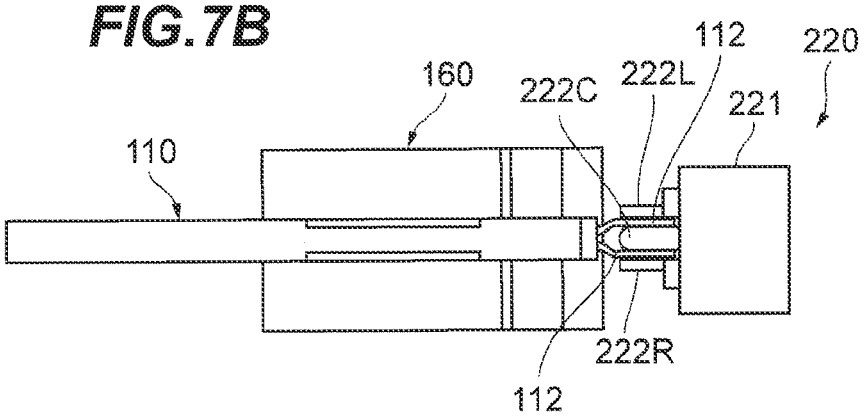
FIG. 7B is a plan view showing a state in which the orientation adjusting unit grips the electric wire.
Figure 7C:
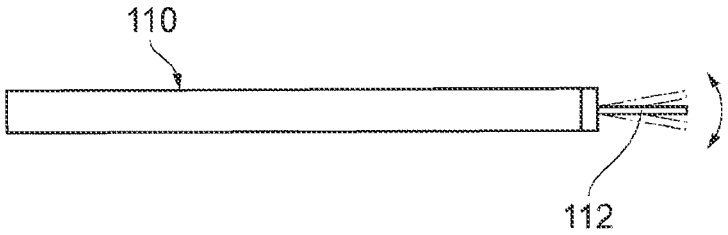
FIG. 7C is a side view showing a state of the electric wire during the orientation adjustment.

The orientation adjustment of the electric wire 112 by the electric wire orientation adjuster 220 is performed, for example, as follows. First, the electric cable 110 held by the cable retainer 160 is carried from the cable insertion unit 8 to the electric wire orientation adjustment unit 11 by the cable carrier 210 so that the two electric wires 112 of the electric cable 110 are positioned in front of the electric wire holder 221 (see FIG. 7A). Next, the electric wire holder 221 with the three holding pieces open is moved to approach the electric cable 110 so that the central holding piece 222C enters between the two electric wires 112 so that the left holding piece 222L is positioned on the left side of the left electric wire 112 and the right holding piece 222R is positioned on the right side of the right electric wire 112. Then, the three holding pieces are closed, and the two electric wires 112 are held (see FIG. 7B). After the holding, as shown in FIG. 7C, the electric wire holder 221 is swung in the vertical direction so that the two electric wires 112 are swung in the vertical direction thereof. After swinging, the three holding pieces are opened at a position where the two electric wires 112 are horizontal so that the holding of the two electric wires 112 is released, and the electric wire holder 221 is moved away from the electric cable 110. In FIG. 7C, the electric wire holder 221 and the cable holder 160 are not shown.

Figure 2C:
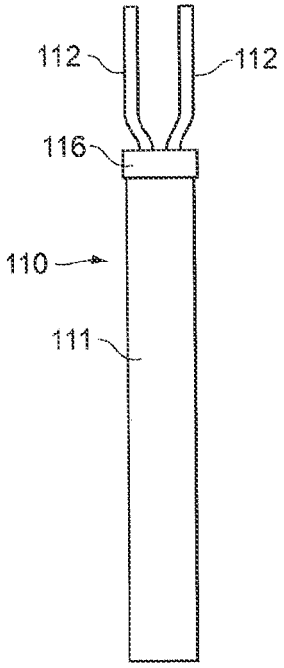
FIG. 2C shows the state of the electric cable in which the orientation of the electric wire is adjusted.

The series of operations of the electric wire holder 221, as described above, adjust the orientation (redress the orientation) of the two electric wires 112. As shown in FIG. 2C, the base portions of the two electric wires 112 after the orientation adjustment extend from the tip portion of the sheath 111 to spread to the left and right, and the tip portions are substantially parallel to each other and aligned in the left-right direction. Adjusting the orientation of the two electric wires 112 in this manner can adjust the orientation of the tip end of the two electric wires 112 extending from the tip portion of the sheath 111 to an orientation that facilitates the cutting operation of the two electric wires 112 and the stripping operation of the covering body 114 after the orientation adjustment. Therefore, the electric cable 110 having the two electric wires 112 after orientation adjustment (also referred to as "orientation-adjusted-electric-wire cable 110") enables cutting and stripping operation with high accuracy. After the orientation adjustment of the two electric wires 112, the cable carrier 210 carries the orientation-adjusted-electric-wire cable 110 held by the cable retainer 160 from the electric wire orientation adjustment unit 11 to the electric-wire-cutting-and-cover-stripping unit 12.

Figure 8:
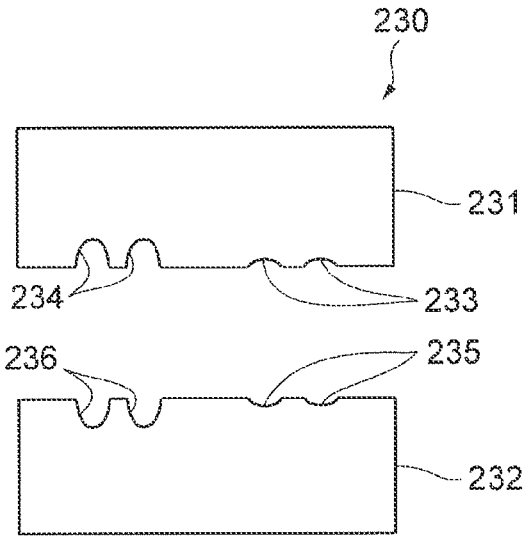
FIG. 8 is a front view showing a configuration of an electric-wire-cutting-and-cover-stripping device of the terminal crimping device.

As shown in FIG. 6, the electric-wire-cutting-and-cover-stripping unit 12 is provided with an electric-wire-cutting-and-cover-stripping device 230. The electric-wire-cutting-and-cover-stripping device 230 includes a pair of upper and lower cutting-and-cover-stripping members 231 and 232 and a cutting-and-cover-stripping member operating mechanism (not shown) for operating the cutting-and-cover-stripping members 231 and 232. As shown in FIG. 8, the upper cutting-and-cover-stripping member 231 has a pair of left and right upper cutting blades 233 and a pair of left and right upper stripping blades 234. The lower cutting-and-cover-stripping member 232 has a pair of left and right lower cutting blades 235 and a pair of left and right lower stripping blades 236.

Figure 2D:
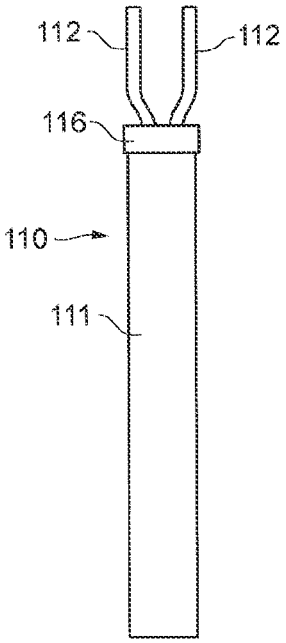
FIG. 2D shows the state of the electric cable after the electric wire is cut off.
Figure 2E:
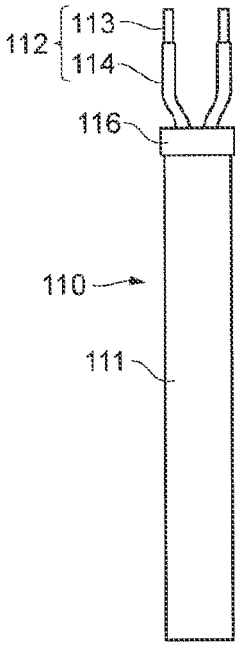
FIG. 2E shows the state of the electric cable after the electric wire is stripped off.

The electric-wire-cutting-and-cover-stripping device 230 cuts the electric wire 112, for example, as follows. First, the cable carrier 210 carries the orientation-adjusted-electric-wire cable 110 held by the cable retainer 160 from the electric wire orientation adjustment unit 11 to the electric-wire-cutting-and-cover-stripping unit 12 so that the two electric wires 112 of the orientation-adjusted-electric-wire cable 110 are positioned between the pair of upper cutting blades 233 of the upper cutting-and-cover-stripping member 231 and the pair of lower cutting blades 235 of the lower cutting-and-cover-stripping member 232. At this time, the relative positions of the cutting-and-cover-stripping members 231 and 232 and the orientation-adjusted-electric-wire cable 110 are adjusted in accordance with the intended cutting positions of the two electric wires 112. Next, the cutting-and-cover-stripping member 231 and the cutting-and-cover-stripping member 232 are moved in vertically opposite directions relative to each other so that the cutting-and-cover-stripping member 231 and the cutting-and-cover-stripping member 232 approach each other, and the two electric wires 112 are cut at one time by the pair of upper cutting blades 233 and the pair of lower cutting blades 235. This cutting operation adjusts the length of the two electric wires 112 extending from the tip portion of the sheath 111. In the electric cable 110 having the two cut electric wires 112 (also referred to as the "cut-electric-wire cable 110"), as shown in FIG. 2D, the length of the two electric wires 112 extending from the tip portion of the sheath 111 is shorter than the two electric wires 112 before cutting (see FIG. 2C).

The electric-wire-cutting-and-cover-stripping device 230 performs cover stripping of the electric wire 112, for example, as follows. First, the cut-electric-wire cable 110 held by the cable retainer 160 is carried by the cable carrier 210 so that the two electric wires 112 of the cut-electric-wire cable 110 are positioned between the pair of upper stripping blades 234 of the upper cutting-and-cover-stripping member 231 and the pair of lower stripping blades 236 of the lower cutting-and-cover-stripping member 232. At this time, the relative position adjustment between the cutting-and-cover-stripping members 231 and 232 and the cut-electric-wire cable 110 is performed in accordance with the intended stripping positions of the covering bodies 114 of the two electric wires 112. Then, the two cutting-and-cover-stripping members 231 and 232 are moved relatively in vertically opposite directions in such a manner that the cutting-and-cover-stripping member 231 and the cutting-and-cover-stripping member 232 approach each other, and the pair of upper stripping blades 234 and the pair of lower stripping blades 236 cut into the covering bodies 114 at the tip ends of the two electric wires 112, holding the tip ends of the two electric wires 112. The two cutting-and-cover-stripping members 231 and 232 are moved rearward away from the cut-electric-wire cables 110 with holding the tip end of the two electric wires 112, and the covering bodies 114 at the tip ends of the two electric wires 112 are stripped from the positions where the upper stripping blades 234 and the lower stripping blades 236 have cut. In the electric cable 110 (also referred to as the "electric-wire-and-stripped-cover cable 110") in which such a stripping operation of the covering bodies 114 is performed, a part of the covering bodies 114 at the tip ends of the two electric wires 112 are stripped off, and the core wires 113 at the portions covered by the stripped covering bodies 114 are exposed (see FIG. 2E). After stripping the covering bodies 114 in the two electric wires 112, the cable carrier 210 carries the electric-wire-cover-stripped cables 110 held by the cable retainer 160 from the electric-wire-cutting-and-cover-stripping unit 12 to the inspection work unit 13.

As shown in FIG. 6, an image inspection device 240 is provided in the inspection work unit 13. The image inspection device 240 includes a photographing camera 241, a pair of left and right upper illumination lamps 242 for illuminating downward from the upper portion, a lower illumination lamp 243 for illuminating upward from the lower portion, and a lower surface image analysis unit (not shown). It is configured to perform an inspection (also referred to as an "inspection of stripped cover portion") of a stripped portion (a portion where the covering body 114 of the two electric wire 112 is stripped) of the electric-wire-cover-stripped cable 110 by image analysis.

The inspection of the stripped cover portion by the image inspection device 240 proceeds, for example, as follows. First, the cable carrier 210 carries the electric-wire-cover-stripped cable 110 held by the cable retainer 160 from the electric-wire-cutting-and-cover-stripping unit 12 to the inspection work unit 13 so that the two wires 112 of the electric-wire-cover-stripped cable 110 are positioned within the imageable range of the photographing camera 241. Next, a pair of upper illumination lamps 242 and lower illumination lamp 243 illuminate the two wires 112. The imaging camera 241 images the two wires 112. The image analysis section analyzes the image data of the two wires 112 taken and inspects the presence or absence of abnormality in the cover-stripped sections. The image of the two wires 112 taken is displayed on the image display monitor 6 (see FIG. 1). After the inspection of stripped cover portion, the cable carrier 210 carries the electric-wire-cutting-and-cover-stripped cable 110 held by the cable retainer 160 from the inspection section 13 to the terminal crimping work unit 14.

As shown in FIG. 6, the terminal-supply-and-carrying-work unit 15 is provided with a terminal supply unit 250, a terminal cutting unit 260, and a terminal carrying unit 270. The terminal supply unit 250 includes a terminal carrier transport stage 251 on which long terminal carriers 140 (with terminals 130) fed from a terminal reel 9 (see FIG. 1)) is placed, a terminal carrier transport unit 252 for intermittently transporting the terminal carrier 140 placed on the terminal carrier transport stage 251 rightward by a predetermined distance, and a terminal carrier transport unit operating mechanism (not shown) for operating the terminal carrier transport unit 252 to be movable in the left-right directions within the terminal-supply-and-carrying-work unit 15. The terminal carrier transport unit 252 includes an engaging piece 253 protruding downward. The engaging piece 253 engages with the engaging holes 142 and 143 of the terminal carrier 140 to transport the terminal carrier 140 (see also FIGS. 9 and 10).

As shown in FIG. 6, the terminal cutter 260 includes a terminal upper cutting blade member 261, a terminal lower cutting blade member 262, and a terminal cutting blade operating mechanism (not shown) for operating the terminal upper cutting blade member 261 and the terminal lower cutting blade member 262. The terminal upper cutting blade member 261 includes a terminal cutting blade (not shown) facing downward, and the terminal lower cutting blade member 262 includes a terminal cutting blade (not shown) facing upward. The terminal cutting device 260 operates the terminal upper cutting blade member 261 to disconnect terminal 130 from the terminal carrier 140 (see also FIGS. 9 and 10).

Figure 9:
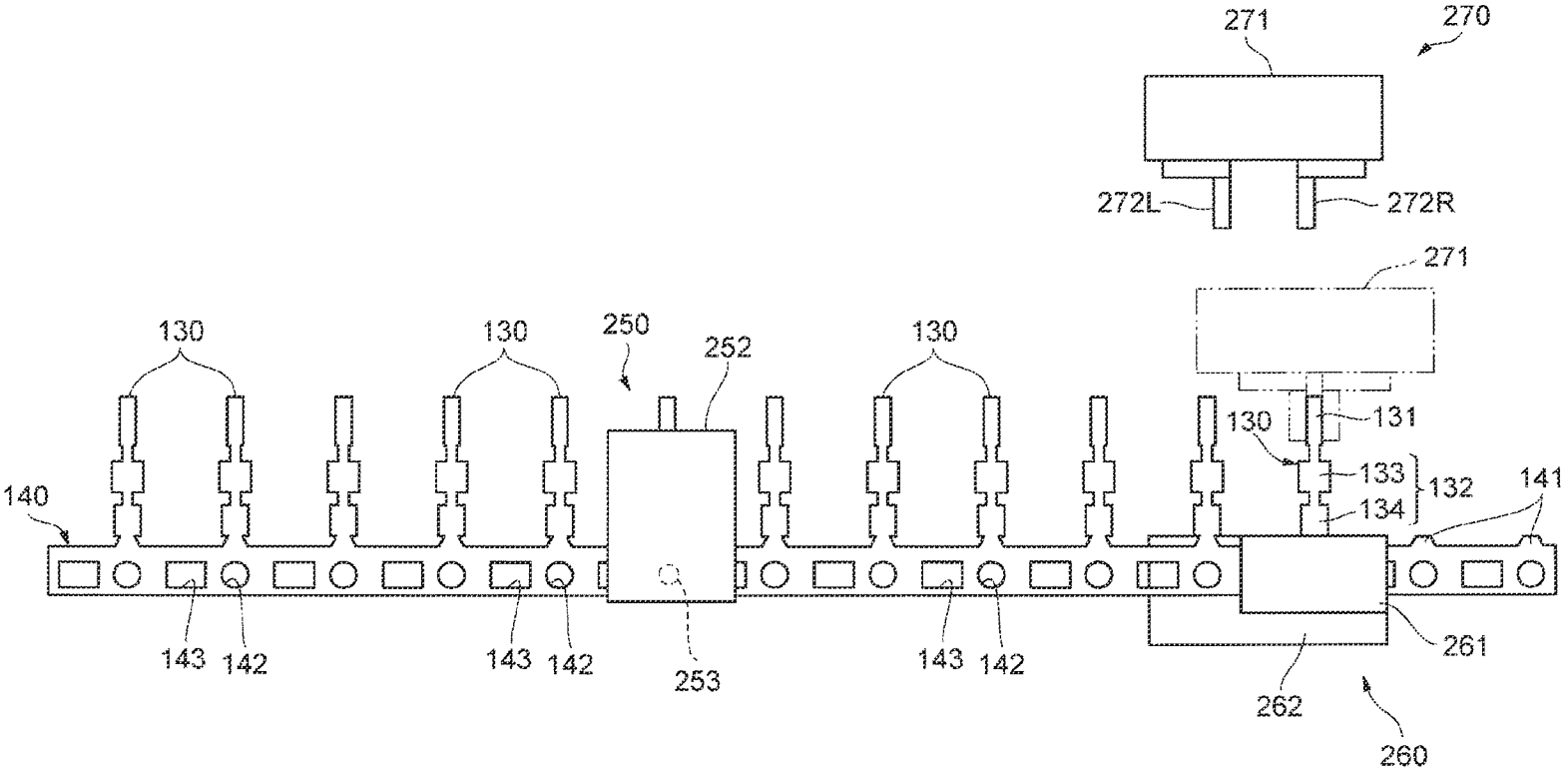
FIG. 9 is a plan view schematically showing a configuration of a terminal supply unit, a terminal cutter, and a terminal carrying unit of the terminal crimping device.
Figure 10:
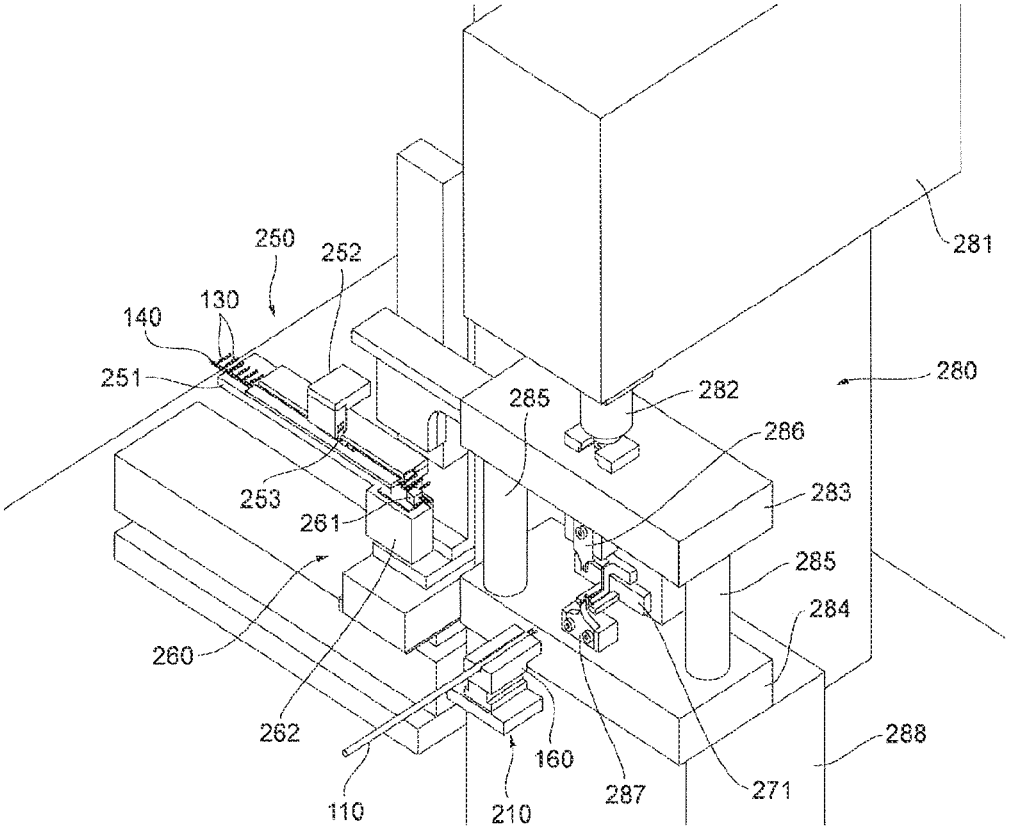
FIG. 10 is a perspective view showing a configuration of a terminal supply unit, a terminal cutting unit, and a crimping device of the terminal crimping device.

As shown in FIG. 6, the terminal carrying unit 270 is provided with a terminal holder 271 and a terminal holder operating mechanism (not shown) for operating the terminal holder 271 to be movable in the forward, backward, left, right, up, and down directions. The terminal holder 271 has a pair of left and right terminal holding pieces 272L and 272R that can open and close and are movable. As shown in FIG. 9, the terminal holder 271 holds the terminal 130 that is separated from the terminal carrier 140 by the terminal cutter 260 at a stage before the terminal is separated (concretely, the terminal holding pieces 272L and 272R hold the electric connection unit 131 of the terminal 130), and carries the separated terminal 130. Terminal carrying unit 270 carries the terminal 130 held by the terminal holder 271 from the terminal-supply-and-carrying-work unit 15 to the terminal crimping work unit 14.

Figure 11:
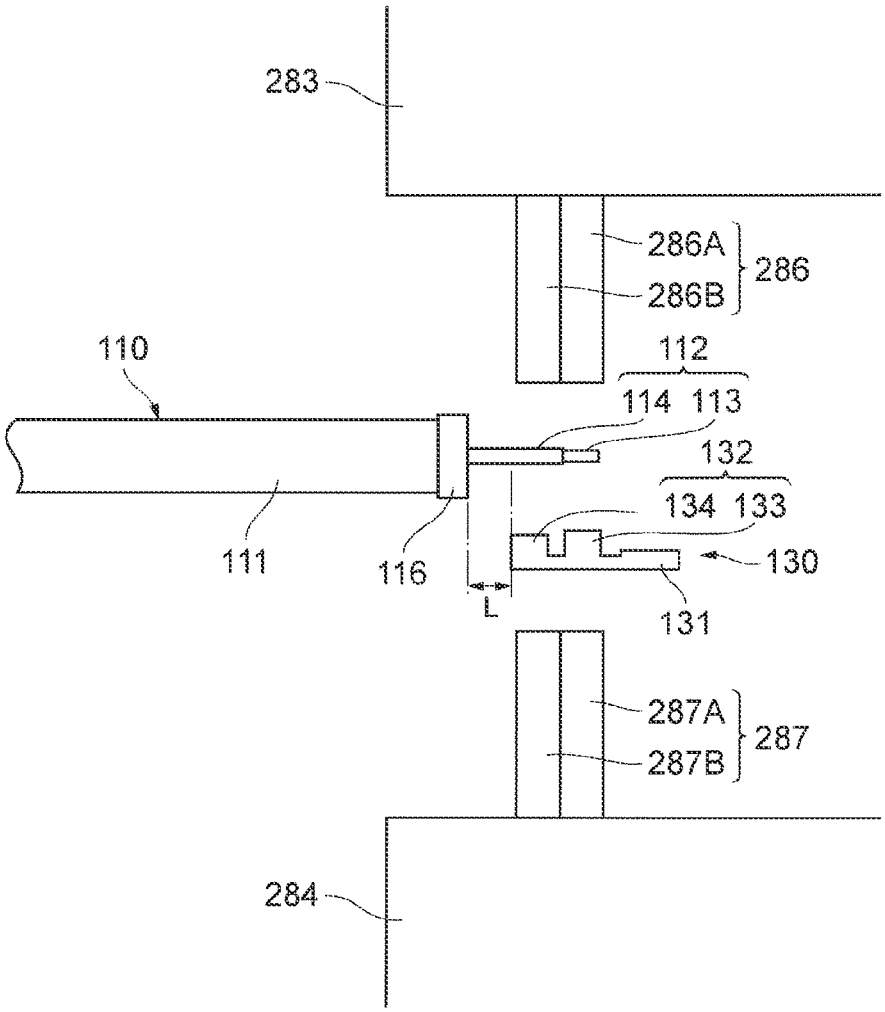
FIG. 11 is a schematic view for explaining the function of the crimping device.

As shown in FIG. 6, a crimping device 280 is provided in the terminal crimping work unit 14. The crimping device 280 is of a type called a die set. It includes a press machine 281, an upper mold 283 mounted on a cylinder rod 282 of the press machine 281, a lower mold 284 mounted on a support frame 288, a guidepost 285 provided between the upper mold 283 and the lower mold 284 to guide the movement of the upper mold 283 in the vertical direction, a crimper 286 provided in the upper mold 283, and an anvil 287 provided in the lower mold 284 (see also FIG. 10). A curved receiving portion (not shown) is provided in the upper-end portion of the anvil 287 to support the crimping portion 132 of terminal 130 from the lower side. A pressing curved surface portion (not shown) is provided in the lower end portion of the crimper 286 to deform the crimping portion 132 while bending it plastically. As shown in FIG. 11, the crimper 286 includes a first crimper 286A for the core wire crimping piece unit 133 of the terminal 130 and a second crimper 286B for the covering-body-crimping-piece portion 134. The anvil 287 includes a first anvil 287A for the core wire crimping piece unit 133 and a second anvil 287B for the covering-body-crimping-piece portion 134. The crimping device 280 crimps the terminal 130 against the tip end of the electric wire 112 of the electric cable 110 (electric-wire-cover-stripped cable 110) by moving the upper mold 283 downward by the press machine 281 to fit the crimper 286 and the anvil 287 together.

The crimping device 280 crimps the terminal 130 to the electric wire 112, for example, as follows. FIG. 11 schematically shows the forward and reverse relative positional relationship of the electric wire 110, the terminal 130, the first anvil 287A, the second anvil 287B, the first crimper 286A, and the second crimper 286B at the time of the terminal crimping in the following description (the terminal carrying unit 270 and the cable carrier 210 are not shown). First, the terminal 130 separated from the terminal carrier 140 is carried by the terminal carrying unit 270 from the terminal-supply-and-carrying-work unit 15 to the terminal crimping work unit 14, and the core wire crimping piece unit 133 of terminal 130 is set to be the receiving portion of the second anvil 287A, and the covering-body-crimping-piece portion 134 of the terminal 130 is set to be positioned at the receiving portion of the first anvil 287B.

Next, a cable carrier 210 carries an electric-wire-cover-stripped cable 110 held by a cable retainer 160 from an inspection work unit 13 to a terminal crimping work unit 14, a core wire 113 part at the tip end of the electric wire 112 (one of the two wires) of the electric-wire-cover-stripped cable 110 is set to be positioned at the core wire crimping piece unit 133 of the terminal 130. A part covered by the covering body 114 is set to be positioned at the covering-body-crimping-piece portion 134. Then, a crimping device 280 is set so that the first crimper 286A and the first anvil 287A are fitted together, the second crimper 286B and the second anvil 287B are fitted together, the upper mold 283 is moved downward by a press machine 281, the core wire crimping piece unit 133 of the terminal 130 is crimped to the core wire 113 part at the tip end of the electric wire 112. The covering-body-crimping-piece portion 134 is crimped to the part covered by the covering body 114 at the tip end of the electric wire 112. In this manner, the crimping device 280 performs the crimping of terminal 130 on two electric wires 112 separately. When the crimping of the terminal 130 on one electric wire 112 is completed, the cable carrier 210 moves the electric wire 112 to be removed from between the crimper 286 and the anvil 287. Next, another terminal 130 separated from the terminal carrier 140 is carried from the terminal-supply-and-carrying-work unit 15 to the terminal crimping work section 14 by the terminal carrying unit 270, and is set in the same manner as described above. Then, the other electric wire 112 having no terminal crimping is set by the cable carrier 210 in the same manner as described above, and the terminal 130 is also crimped to the electric wire 112 in the same manner as described above.

Figure 2F:
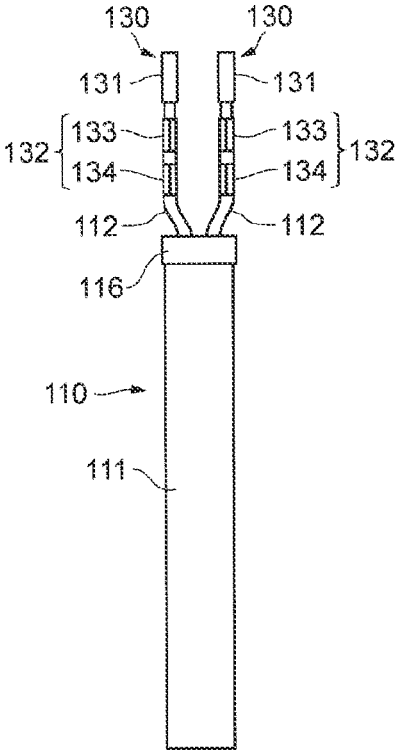
FIG. 2F shows the state of the electric cable in which the terminal is crimped to the electric wire.

When the extension length of the electric wire 112 from the sheath 111 is short, the distance L (see FIG. 11) from the tip portion of the sheath 111 to the portion to be crimped (the portion to be crimped with the terminal 130) of the electric wire 112 is also short. Therefore, when the terminal 130 is carried to the terminal crimping work unit 14 with the terminal carrier 140 provided or with the carrier piece attached thereto, the terminal carrier 140 or the carrier piece interferes with the sheath 111 or the cable retainer 160, and the positional deviation between the terminal 130 and the electric wire 110 is likely to occur. In the present embodiment, since terminal 130 is carried to the terminal crimping portion 14 with the terminal carrier 140 completely separated from the terminal carrier (with no carrier piece remaining), there is no such concern. The terminal 130 can be appropriately crimped against the electric wire 112 while suppressing the positional deviation between terminal 130 and the electric wire 112. An electric cable 110 (also referred to as "electric cable with terminal 110") in which terminal 130 has been crimped against two electric wires 112 is illustrated in FIG. 2F.

After completion of the crimping of the terminal 130 to each electric wire 112, the electric cable 110 with the terminal held in the cable retainer 160 is carried from the terminal crimping work unit 14 to the inspection work unit 13 by the cable carrier 210. At this time, the image inspection device 240 of the inspection work unit 13 performs an inspection (also referred to as "crimping section inspection") of the crimping section (the section where the terminals 130 of the two electric wires 112 are crimped) of the electric cable 110 with the terminal by image analysis. This crimping section inspection proceeds in the same procedure as the cover stripping section inspection described above and inspects the presence or absence of an abnormality in the crimping section. After the crimping section inspection, the cable carrier 210 carries the cable retainer 160, holding the electric cable 110 with the terminal from the inspection section 13 to the cable insertion unit 8.

A cable retainer 160 carried to a cable insertion unit 8 is removed from a cable carrier 210 (holding member 211 of a cable carrier moving body 112) and is taken out from the cable insertion unit 8. Another cable retainer 160 holding an electric cable 110 to which terminals are not crimped is attached to the holding member 211 of the cable carrier moving body 112 standing by the cable insertion unit 8. The cable retainer 160 taken out from the cable insertion unit 8 is carried to a cable set base 7. The electric cable 110 with terminals held therein is taken out from the cable retainer 160 by the operator's manual operation.

Figure 12:
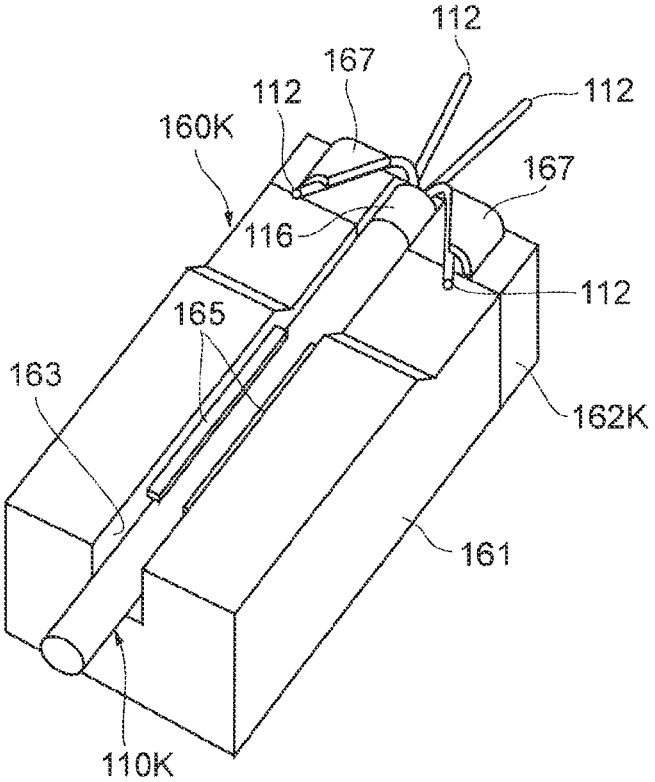
FIG. 12 is a perspective view of a different embodiment of the cable retainer.

Although the electric cable 110 has two electric wires 112, the number of electric wires 112 in the electric cable 110 may be one or three or more. FIG. 12 shows an electric cable 110K with four electric wires 112 and a cable retainer 160K to hold the electric cable 110K. This cable retainer 160K corresponds to the cable retainer 160 shown in FIG. 5, with its attachment unit 162 replaced by another attachment unit 162K. The main body unit 161 is the same as that of the cable retainer 160. The attachment unit 162K includes a pair of left and right electric wire holding units 167 configured to hold two electric wires 112 out of the four electric wires 112 extending from one end portion of the sheath 111 in a bent state toward the other end portion of the sheath 111. By holding the two electric wires 112 in a bent state in the electric wire holding unit 167, the electric wires 112 held in the electric wire holding unit 167 do not get in the way when the terminal crimping work or the like is performed on the other two electric wires 112, thereby improving the workability. In the example of FIG. 11, the electric wires 112 held in the electric wire holding unit 167 are not crimped to a terminal, but the electric wires 112 whose terminals have been crimped may be held in the electric wire holding unit 167.

Although the preferred embodiment of the present invention has been described above, the present invention is not limited thereto and can be appropriately changed without departing from the spirit and scope of the invention.

For example, instead of using the cable retainer 160, the electric cable 110 may be directly installed in the cable carrier moving body 212 to perform various operations such as terminal crimping. In the above embodiment, terminal 130 is crimped to one of the two electric wires 112. Then the terminal 130 is crimped to the other electric wire 112. However, terminal 130 may be crimped to the two electric wires 112 at a time. In the above embodiment, the case in which the electric cable 110 is a high-frequency cable is exemplified, but the present invention can also be applied to the case where the terminal is crimped to an electric cable other than a high-frequency cable.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This invention claims the benefit of Japanese Patent Application No. 2021-008790 which is hereby incorporated by reference.

The invention claimed is:

1. A terminal crimping device for crimping a terminal to a tip end of an electric wire of an electric cable, the electric cable having a tubular sheath and the electric wire housed in the sheath, the terminal crimping device comprising:

a cutter for cutting off a terminal provided on a band-shaped terminal carrier from the terminal carrier;

a terminal carrying unit for carrying the terminal separated from the terminal carrier by the cutting unit to a crimping position;

a cable carrier for carrying the electric cable to the crimping position;

a crimper provided at the crimping position for crimping the terminal carried to the crimping position by the terminal carrying unit to the tip end of the electric wire of the electric cable carried to the crimping position by the cable carrying unit; and an orientation adjuster for adjusting an orientation of the tip end of the electric wire before the crimper crimps the terminal;

wherein the cable carrier carries the electric cable to an adjustment position where the orientation adjuster is provided, and wherein the orientation adjuster grips the tip end of the electric wire of the electric cable carried to the adjustment position by the cable carrier and adjusts the orientation by swinging the gripped tip end of the electric wire.

2. The terminal crimping device according to claim 1, the electric wire having a core wire and a covering body for insulating the core wire, the terminal crimping device further comprising:

a cover stripper for stripping the cover from the electric wire whose orientation is adjusted by the orientation adjuster, wherein the cable carrier carries the orientation-adjusted cable in which the orientation adjuster adjusted the orientation of the electric wire to a stripping position where the cover stripping unit is provided, and the cover stripping device strips off a part of the covering body at the tip end while holding the tip end of the electric wire of the orientation-adjusted cable carried to the stripping position by the cable carrying device.

3. The terminal crimping device according to claim 2, wherein the cable carrier carries a terminal-equipped cable, which is formed by crimping the terminal to the tip end of the electric wire of the electric cable by the crimping device, from the crimping position to a take-out position using a cable transport device, the terminal crimping device further comprising a crimping part inspection device for inspecting the crimping part of the terminal-equipped cable by image analysis while the cable carrier is transporting the terminal-equipped cable from the crimping position to the take-out position using the cable transport device.

4. The terminal crimping device according to claim 3, wherein the cable carrying unit carries a stripped cable having a part of the covering body stripped from a tip end of the electric wire by the covering stripping unit from the stripping position to the crimping position; and the crimping part inspection device inspects the stripped part of the stripped cable by image analysis while the cable transport device is transporting the stripped cable from the stripping position to the crimping position.

5. The terminal crimping device according to claim 1, further comprising a cable retainer for holding the electric cable in a state where the electric wire extends from one side edge portion;

wherein the cable carrier has a movable retainer installation unit on which the cable retainer holding the electric cable is installed, and the electric cable is carried by moving the movable retainer installation unit on which the cable retainer is installed.

6. The terminal crimping device according to claim 5, the electric cable having a plurality of electric wires, wherein the cable retainer is for holding a part of the plurality of electric wires bent toward the other end of the sheath when holding the electric cable.

* * * * *